United States Patent [19]

Borja et al.

[11] 4,301,194

[45] Nov. 17, 1981

[54] CHEMICAL MILLING MASKANT APPLICATION PROCESS

[75] Inventors: Arthur Borja, Anaheim; Frans Van Otterdyk, Long Beach, both of Calif.

[73] Assignee: Purex Corporation, Lakewood, Calif.

[21] Appl. No.: 36,090

[22] Filed: May 4, 1979

[51] Int. Cl.[3] ..... B65B 33/00

[52] U.S. Cl. ..... 427/154; 427/156; 427/299; 427/335; 427/378; 427/388.5; 427/430.1; 427/435

[58] Field of Search ..... 427/435, 156, 335, 154, 427/299, 378, 388.5, 430.1; 260/33.8 R

[56] References Cited

U.S. PATENT DOCUMENTS

| | | | |
|---|---|---|---|
| 42,457 | 4/1864 | Bassett | 427/435 |
| 1,357,498 | 11/1920 | Houskeeper | 427/435 |
| 2,515,489 | 7/1950 | Borushko | 118/61 |
| 2,631,137 | 3/1953 | Loritsch | 427/435 |
| 2,739,567 | 3/1956 | Jones et al. | 118/61 |
| 3,055,777 | 9/1962 | Grad | 427/435 |
| 3,338,738 | 8/1967 | Lindemann | 427/435 |
| 3,541,042 | 10/1970 | Levy | 525/152 |
| 3,544,400 | 12/1970 | Deutsch | 427/156 |
| 3,649,584 | 3/1972 | Bailey | 260/31.2 MR |
| 3,898,355 | 8/1975 | O'Keley | 427/314 |

FOREIGN PATENT DOCUMENTS

| | | |
|---|---|---|
| 1048735 | 11/1966 | United Kingdom . |
| 1196204 | 6/1970 | United Kingdom . |
| 1254848 | 11/1971 | United Kingdom . |
| 1311002 | 3/1973 | United Kingdom . |

OTHER PUBLICATIONS

Bird et al., Transport Phenomena, pp. 37–42, Wiley & Sons Inc., N.Y., 1960.

McCabe et al., Unit Ops. of Chem. Eng., pp. 117–119, McGraw Hill, NY, 2nd ed., 1956.

Doolittle, Technology of Solvents and Plasticizers, pp. 454, 700, 701, Wiley & Sons, Inc., London, 1930.

*Primary Examiner*—Michael R. Lusignan
*Assistant Examiner*—Richard Bueker
*Attorney, Agent, or Firm*—William W. Haefliger

[57] ABSTRACT

A process for applying a volatile liquid maskant to an article to be subjected to chemical milling includes the steps:

(a) providing a controlled temperature bath of said volatile maskant characterized as fast drying, and also providing a vapor blanket overlying the bath, (b) placing the article into position above the level of the bath and blanket, and adjusting the temperature of the article in relation to the bath temperature, (c) lowering the article through the blanket into the bath, and withdrawing the article upwardly from the bath and through the blanket at a controlled rate characterized in that the maskant coats the article to controlled coat thickness, and also in that the bath remains substantially free of return drainage of maskant off the withdrawn article, (d) and, following said upward withdrawal, flowing a gas stream into contact with the maskant coat while the article remains above the level of the bath to assist in rapid drying of the maskant.

13 Claims, 4 Drawing Figures

CARBON ADSORPTION UNIT
AIR FILTER
AIR BLOWER
AIR DEHUMIDIFIER
COOL
HEAT
AIR HEATER

CHEMICAL MILLING MASKANT APPLICATION PROCESS

BACKGROUND OF THE INVENTION

This invention relates generally to application of maskants to metal surfaces to be subjected to chemical etching or milling; more specifically, it concerns the solving of problems that have arisen in this field.

At present, it is usual practice to dip the article or part to be coated at least twice in the maskant bath in order to obtain the desired uniform thickness. Thus for example, the part will be suspended or supported and dipped once (down and up) into the bath to produce a tapered coat; and the part will then be vertically reversed, and dipped again to produce a reversely tapered coat. The two coats then add up to a generally uniform lateral thickness along the vertical length of the surface. Such practice not only requires two dips, which are time consuming and hence costly, but other problems ensue. For example, it is common experience that drainage of the maskant liquid off the part and back into the bath results in air entrainment. Pin hole air bubbles are formed in the bath due to such air entraining drainage, and the bubbles then become located in films formed on subsequently dipped parts, which produce defects upon chemical etching or milling.

SUMMARY OF THE INVENTION

It is a major object of the invention to provide solutions to the above described problems as well as other problems and disadvantages encountered in practice. As will be seen, the invention has various aspects, including process, apparatus and novel maskant composition.

Referring first to the novel process, it involves the following basic steps:

(a) providing a controlled temperature bath of the volatile maskant characterized as fast drying, and also providing a vapor blanket overlying the bath, (b) placing the article into position above the level of the bath and blanket, and adjusting the temperature of the article in relation to the bath temperature, (c) lowering the article through the blanket into the bath, and withdrawing the article upwardly from the bath, and through the blanket at a controlled rate characterized in that the maskant coats the article to controlled coat thickness, and also in that the bath remains substantially free of return drainage of maskant off the withdrawn article.

(d) and, following such upward withdrawal, flowing a gas stream into contact with the maskant coat while the article remains above the level of the bath to assist in rapid drying of the maskant.

As will be seen, the temperature of the vapor blanket is kept lower than that of the bath, and the temperature of the article holding zone above the blanket is kept lower than that of the bath, the article being typically cooled in the holding zone, all to the ends that the article is conditioned to the temperature of the holding zone, the blanket is kept immediately above the bath, loss of the volatile solvent is minimized, and the coating on the article may be rapidly dried by gaseous streams in the holding zone. Also, the viscosity of the bath is adjusted and the withdrawal rate of the article from the bath is kept within a predetermined range so that only one dip of the article in the bath is required, and also that drainage of maskant off the article into the bath is prevented. The composition of the maskant bath also contributes to these objectives.

In its apparatus aspects, the invention fundamentally comprises:

(a) a tank to receive a controlled temperature bath of maskant, (b) first means associated with the tank to control the temperature of the bath, (c) second means about a vapor blanket zone immediately above the bath zone to control the temperature of vapor in that zone, thereby to maintain the vapor adjacent the bath surface, (d) an enclosure above the level of the tank defining an upper zone to receive an article to be lowered through the blanket and into the bath, and then withdrawn upwardly from the bath and through the blanket at a controlled rate to coat the article with maskant and to control coat thickness for subsequent upward reception of the coated article into the upper zone, (e) and other means for flowing gaseous streams into the enclosure and into contact with the article in the upper zone, and for withdrawing the gaseous streams from said upper zone.

As will be seen, temperature control means is typically provided to control the temperature of the gaseous streams flowing horizontally in the upper "holding" zone, above the vapor blanket, to minimize loss of volatile solvents and to aid temperature adjustment of the article to be coated, and drying of the coat after dipping.

The maskant composition typically comprises a film forming solids matrix and a solvent therefor, the bulk of the solvent consisting of methylene chloride, the liquid composition having a viscosity of between about 25 and 38 poise in a bath from which parts are slowly withdrawn at rates between about 12 and 26 inches per minute. As will appear, the solids portion of the maskant typically consists of elastomer, reinforcing agents, phenolic resin and additives; and the solvent composition includes, in addition to methylene chloride, substances selected from the group consisting of 1,1,1-trichloroethane, perchloroethylene, toluene, ketones, glycol ethers, and petroleum naphthas.

As will appear, a maskant composition with a fast drying volatile, non-flammable solvent such as methylene chloride or 1,1,1-trichloroethane or blends thereof having a relatively low toxicity or a blend with other solvents to alter the solubility but within the limits of air pollution requirements will materially reduce the processing time. Solvents such as petroleum hydrocarbons, ketones, glycol ethers, esters, and alcohols may be blended with methylene chloride to enhance the solubility of the solvent. As an example, a maskant with a solvent composition by volumn of 75%–80% methylene chloride, 4%–5% methyl isobutyl ketone, and 16%–20% VM & P Naphtha has produced films of any desired thickness up to 20 mils. With a highly volatile solvent or solvent blend, the thickness of the vapor blanket over the surface of the maskant at the line of withdrawal may be controlled as well as the viscosity and rate of withdrawal for optimum results. Since by this method the length of flow of maskant on the article surface may be held to a short distance, the length of the surface that can be coated may be infinite, by the proper adaptions of the application vessel and the application equipment.

In this regard, and as a general rule, the thicker the vapor blanket, the faster the withdrawal rate of the article from the bath, to produce "one dip" maskant coatings of adequate thickness for chemical milling or etching (i.e. from 0.004 inches to 0.012 inches).

These and other objects and advantages of the invention, as well as the details of an illustrative embodiment, will be more fully understood from the following description and drawings, in which:

DRAWING DESCRIPTION

DETAILED DESCRIPTION

Figures 1, 2, 3, 4:
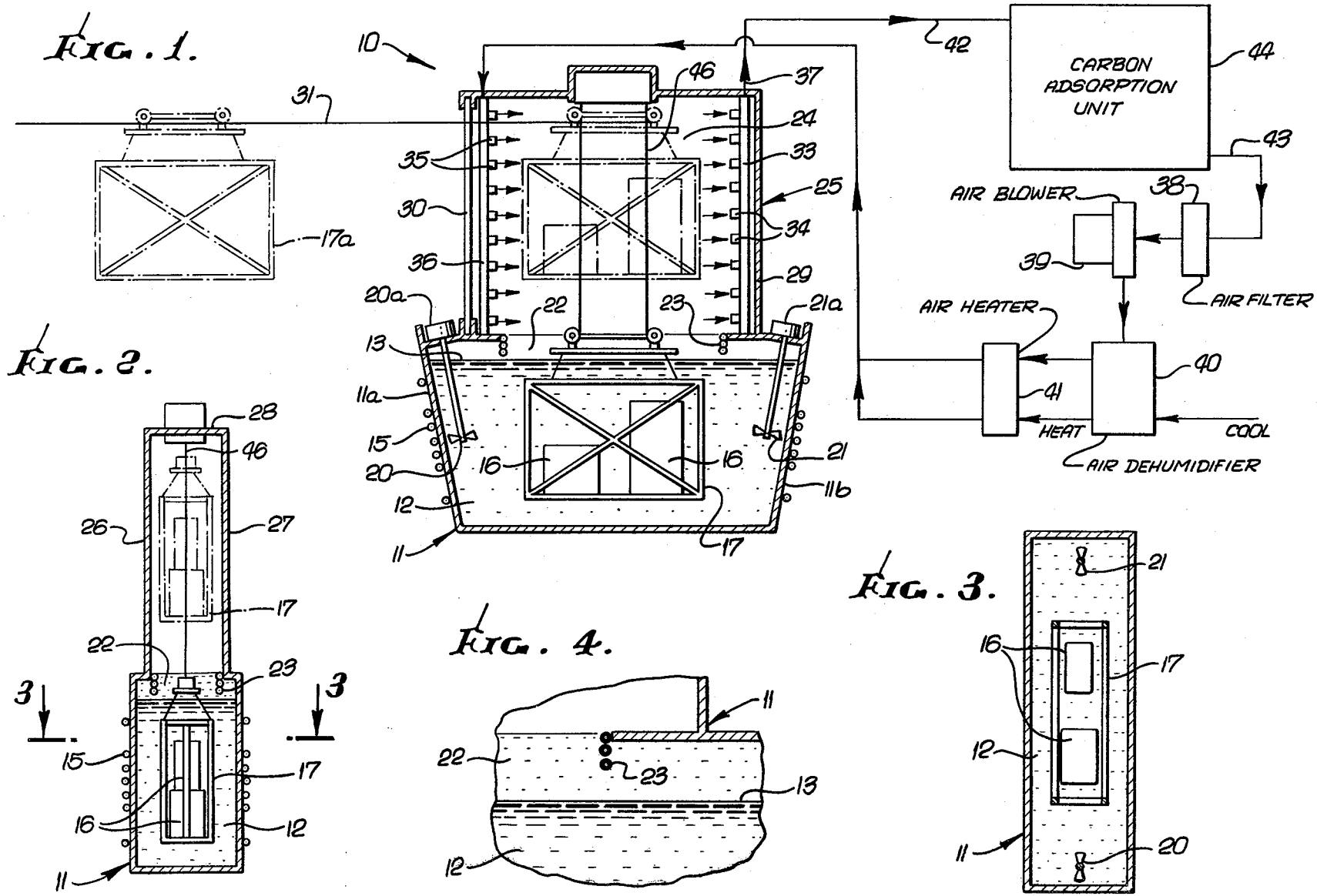
FIG. 1 is an elevation section, showing one form of processing apparatus embodying the invention.
FIG. 2 is an end view, in section, showing interior details of the FIG. 1 apparatus.
FIG. 3 is a horizontal section taken on lines 3—3 of FIG. 2.
FIG. 4 is a fragmentary section showing the relationship of the maskant bath to the vapor blanket.

The apparatus 10 shown in FIGS. 1–3 is employed in a process to apply a volatile liquid maskant to an article to be later subjected to chemical milling. The apparatus includes a tank 11 to receive a controlled temperature bath of the liquid maskant, in a bath zone 12. The top level of the bath is indicated at 13, just below coil or coils 23 in the tank. A lower coil or coils 15 extends about the tank, as shown. Liquid may circulate in the lower coil 15 to control the temperature of the bath liquid to about 74° F., for effective coating of a metal part or parts. Such parts, indicated at 16, are typically carried by a rack 17 lowered into the bath liquid. The parts may consist for example of magnesium, aluminum, steel, titanium and alloys thereof, or other metals and alloys. Merely as an example, the bath is maintained at about 74° F., and the part or parts are cooled to a temperature below 74° before lowering thereof into the liquid. FIG. 1 shows vertically upwardly diverging tank opposite end walls 11*a* and 11*b*. Bath liquid mixing rotors such as impellers 20 and 21 are shown adjacent such diverging walls, and at locations shown as spaced lengthwise of the tank in FIG. 1. Drives for the impellers appear at 20*a* and 21*a*.

Immediately above the bath zone is a vapor blanket zone 22, as also shown in FIG. 4, the blanket consisting of bath liquid vapor and serving to prevent or inhibit loss of bath liquid. A cooling coil 23 extends about blanket zone 22, as shown, to remove heat from the vapor and maintain it at a sufficiently low temperature as to inhibit vapor loss upwardly. For example, if the bath temperature is about 74° F., the vapor blanket temperature is kept below 74° F., and the part or parts 16 are cooled to about 70° F. before lowering them through the blanket into the bath, in order to promote their coating by the maskant in the bath, so that desired coating thickness will be formed on slow withdrawal from the bath.

Located above the level of the zones 12 and 22 is an upper zone 24 surrounded by an enclosure 25 and adapted to receive the part or article to be lowered into the bath. Enclosure side walls and top are shown at 26–28 in FIG. 2. The enclosure also has one closed end wall 29 seen in FIG. 1, and an opposite and openable end wall 30. The latter is opened when it is desired to introduce a parts rack 17*a* into zone 24, as for example on a monorail conveyor indicated at 31.

Means is provided for flowing gaseous streams into the zone 24 in contact with the article or parts carried by a rack introduced into that zone, for cooling (or heating) the parts to the temperature level indicated above. For this purpose, air may be introduced into a header duct or ducts 36 in wall 30, to exit via spaced branch ducts 35 opening to one side of zone 24, for creating horizontal streams flowing across that zone toward wall 29. Outlet ducts 34 receive the air streams which flow via header duct 33 to exit at vent outlet 37. In this regard, intake air may be filtered at 38, pressurized by blower 39, cooled and dehumidified at 40, and may be heated at 41 before entry to zone 24 at about 67° F. temperature. In addition, similar air streams may be employed to dry the parts removed upwardly into zone 24 in raised position of rack 17, after dipping into the bath. For that purpose, the intake air may be recirculated as via lines 42 and 43 between which a carbon adsorption unit 44 is connected to remove hydrocarbon solvent vapor from the recirculated air stream, preventing its escape to the exterior. The circulated air may be heated at 41 to expedite drying.

In regard to the above, the apparatus is characterized as enabling rapid handling and one-dip coating of parts, i.e. their temperature adjustment in zone 24 immediately above the bath; lowering of the parts through the vapor blanket into the bath; their upward withdrawal from the bath and through the blanket at a controlled rate to coat the parts with maskant to a controlled coating thickness and without drainage of maskant coating off the part; and reception of the coated parts in the upper zone for quick drying. A suitable lowering and hoisting mechanism for the rack is shown at 46, and that mechanism may be supported by the monorail.

The process for applying a volatile liquid maskant to articles or parts embodies the following basic steps:

(a) providing a controlled temperature bath of the volatile maskant characterized as fast drying, and also providing a vapor blanket overlying the bath, (b) placing the article into position above the level of the bath and blanket, and adjusting the temperature of the article in relation to the bath temperature, (c) lowering the article through the blanket into the bath, and withdrawing the article upwardly form the bath and through the blanket at a controlled rate characterized in that the maskant coats the article to controlled coat thickness, and also in that the bath remains substantially free of return drainage of maskant off the withdrawn article, (d) and, following such upward withdrawal, flowing a gas stream into contact with the maskant coat while the article remains above the level of the bath to assist in rapid drying of the maskant.

In this regard, the viscosity of the maskant liquid in the bath is controlled by bath composition selection and temperature control, and the withdrawal rate from the bath is also controlled, so that only a single dip of the article into the bath is required to coat the article to required maskant thickness, all without maskant drainage off the part back into the bath. This enables drying of the part in the enclosed zone 24 immediately above the bath and vapor blanket zones, in view of absence of drainage off the part, and with the result that the volatile solvent used in the bath is prevented from escaping to the exterior and contaminating the environment. Also, bubble formation in the bath, due to drainage of maskant off the elevated parts and rack, is prevented by elimination of such drainage due to the controlled temperatures of the parts, rack, and zones 12, 22 and 24, the controlled viscosity of the bath liquid, and the controlled rate of withdrawal from the bath. Maintenance of zone 22 at a lower temperature than zone 24 prevents rising of the vapor blanket into zone 24.

Referring now to the maskant itself, it has been discovered that the use of a highly volatile solvent composition enables the application of a protective maskant coating to a metal work piece at a uniform thickness for adequate protection during handling and chemical milling. The use of highly volatile solvent compositions also reduces the drying time so that work pieces coated with maskant made with such highly volatile solvent compositions may be processed within a much shorter period of time after dipping than when the major portion of the solvents comprise toluene, xylene, petroleum naphthas, perchloroethylene or blends thereof. In the past, it was common practice when using these relatively slower evaporating solvents to allow the dipped work piece to drain over the dip tank causing air to be entrained as the liquid maskant flows and drips back into the liquid mask. The air that is entrapped in the form of air bubbles is detrimental causing pinholes and thus obviate the protective characteristics of the film. The present invention eliminates streams of maskant draining and dripping, thereby eliminating that source of pinhole formation.

The solids portion of the maskant compositions according to the invention consists of elastomer, reinforcing agents, phenolic resin, and additives. The individual amounts may range as follows based on 100 weight parts of elastomer:

| | wt. parts |
|---|---|
| Elastomer | 100 |
| Phenolic Resin (Heat Reactive) | 4–15 |
| Hydrocarbon Resins | 0–15 |
| Extending or Rubber Processing Oil | 0–10 |
| Reinforcing/Extending Fillers | 65–175 |
| Antioxidants | 0–5 |
| Reactive Polyvalent Metal Oxide | 1–10 |
| Viscosity Modifier | 0–15 |
| Liquid Organic Polymer | 2–10 |

Usable elastomers include, for example, butyl rubber, chloroprene, nitrile rubber, natural rubber, butadiene-styrene copolymers and blends or mixtures thereof. The block copolymers that may also be used are the copolymers having the general configuration A-B-A. If the copolymer is not hydrogenated, the blocks "A" comprise poly (vinyl arene) blocks, while the "B" block is a poly (conjugated diene) block. The block copolymers in general exhibit molecular weight values of at least 5000 and preferably 15,000 to 100,000 and more for the "A" blocks and 14,000 and preferably 25,000 to 150,000 and more for the "B" block. If the copolymers are hydrogenated, the molecular weight ranges remain in about the same ranges.

Preferred as the rubber component are those disclosed in U.S. Pat. No. 3,649,584 to Bailey & Cummings, column 3, line 65 to column 5, line 36.

Usable phenolic resins include: alkyl-phenolaldehyde type resins such as nonylphenol-aldehyde, characterized by their terminal methylol (—$CH_2$—OH) groups.

Usable hydrocarbon resins include thermoplastic resins with softening points (ring & ball) above 100° C. such as coumarone-indene, copolymers of α-methyl styrene and vinyl toluene, poly α-methyl styrene, polystyrene, polyindene, and other petroleum and natural resins compatible to some degree with the elastomer portion of the composition.

Processing oils used include plasticizers and petroleum oils capable of modifying certain physical properties of the dry maskant. For example, petroleum oil plasticizer such as paraffinic oils, aromatic oils and naphthenic oils. In general paraffinic oils have an aniline point well above 200° F., naphthenic oils have an aniline point range of 140°–210° F., and aromatic oils have an analine point range below 120° F. Ester type plasticizers may also be used such as the phtalates, phosphates and other organic oils compatible to some degree with the elastomer portion of the composition.

Usable fillers include clays, talcs, silicas and carbon black.

Accelerators and Curing Agents: Although accelerators and curing agents are not required for the preferred block polymers, they can be used to protect against oxidation and ozone attack. Examples are dibutyl or diethyl thio ureas, carbamates and thiuram type compounds.

Antioxidants are used to enhance the resistance of the composition to degradation caused by oxygen and other oxidizing agents in the atmosphere. Examples are hindered phenols, zinc dibutyl dithiocarbamate, 2,2-methylene bis(4-methyl, 6-tertiary butyl phenol) and other antioxidants and stabilizers well known to those in the elastomer compounding field.

Polyvalent Metal Oxides which may be used include zinc oxide, magnesium oxide, and calcium oxide. Preferred is magnesium oxide alone or in combination with zinc oxide or calcium oxide.

Viscosity Modifiers may be used to modify the flow properties of the liquid mask. Examples are fine particle size inorganic materials such as asbestos, clay, and silicas or organic type thickeners.

Liquid Organic Polymers are also used to reduce the incidence of voids and pinholes, as disclosed in U.S. Pat. No. 3,649,584.

Solvent compositions which in combination, and in accordance with the present invention will exhibit the properties set forth, are:

| | % by volume |
|---|---|
| Methylene Chloride ($CH_2Cl_2$) | 65–100 |
| 1,1,1-Trichloroethane | 0–26 |
| Perchloroethylene | 0–18 |
| Toluene | 0–20 |
| Ketones | 0–20 |
| Glycol Ethers | 0–5 |
| Petroleum Naphthas | 0–18 |

Suitable solvent combinations are characterized in that the solubility parameter will fall in the range of 8.8–9.5 for maskants using a styrene-butadiene block copolymer such as Kraton 1101, 1102, GX 6500. In this regard, the solubility parameter may be adjusted to solubilize other polymers.

The following examples are presented to more clearly illustrate the compositions and method of preparation.

EXAMPLE 1

The following solids and solvents were employed;

| | wt. % |
|---|---|
| butadiene-styrene block co-polymer (Kraton 1101) | 17.2% |
| Filler (Talc) | 16.0 |
| Phenolic Resin (Bakelite CKR 1634) | 1.2 |
| Hydrocarbon Resin (αmethyl styrene) | 1.6 |
| Antioxidant (hindered bisphenol) | .3 |
| Polyvalent Oxide (magnesium oxide) | .6 |
| Process Oil (napthenic hydrocarbon oil, aniline point 209° F.) | .4 |
| Methylene Chloride | 53.8 |
| Methyl Isobutyl Ketone | 2.1 |
| Petroleum Naphtha | 6.8 |
| | 100.0 |

The filler, resins, and all other ingredients except the polymer were mixed into the methylene chloride until all resins were dissolved and the inorganic materials were homogeneously dispersed. The polymer was then added to the batch under constant mixing until complete solution of the polymer was effected.

The % solids was adjusted to the calculated figure (37.3% by weight) and methyl isobutyl ketone and petroleum naphtha were then added and mixed to obtain a homogeneous liquid maskant.

Solubility Parameter of maskant Solvent Blend=9.2

Viscosity Brookfield #4/60 RPM=50 poise

A solvent blend was then made using:

| | % volume |
|---|---|
| Methylene Chloride | 78% |
| Petroleum Naphtha | 17 |
| Methyl Isobutyl Ketone | 5 |

The viscosity of the maskant was adjusted to 11 poise at ambient, by addition of latter blend to the maskant. A single flow coat was applied to a two foot panel at the 11 poise viscosity, which is typical for dipping and flow coating, resulting in surface wrinkling and a dry film thickness of 4 to 9 mils top to bottom.

In another test a larger tank was used with the above formulation at 20 poise which would coincide with a percentage of non-volatile solids in the neighborhood of 30%. An 8 foot length of coiled metal foil was held at the bottom of the tank and slowly withdrawn up through the surface of the mask coating while uncoiling at the bottom of the tank. Several tests established the following: Film thicknesses of 7 to 8 mils are produced in one dip coat application at a viscosity of 22±2 poise with a 2 inch vapor blanket without sagging of the coating on 8 foot long panels at a withdrawal rate of 14 inches per minute.

EXAMPLE 2

As seen in the following formulation, a viscosity modifier to obtain some thixotropy and a bubble breaking agent (poly isobutylene) were added to the following solids and solvents combined as described above.

| | wt. % |
|---|---|
| Polymer (Kraton 1101) | 14.6 |
| Filler (Talc) | 14.5 |
| Phenolic Resin (Bakelite CKR 1634) | 1.1 |
| Hydrocarbon Resin (αMethyl styrene) | 1.5 |
| Antioxidant (hindered bisphenol) | 0.3 |
| Bubble Release Agent (polyisobutylene) | 1.3 |

-continued

| | wt. % |
|---|---|
| Viscosity Modifier (fine particle chrysolite asbestos) | 0.4 |
| Polyvalent Oxide (Magnesium oxide) | 0.5 |
| Process Oil (Shelflex 371) | 0.4 |
| Methylene Chloride | 56.3 |
| Petroleum Naphtha | 7.0 |
| Methylene Isobutyl Ketone | 2.1 |
| | 100.0% |
| Solubility Parameter of blend | 9.2 |
| % Solids, by weight | 34.0% |
| Viscosity | 29 poise |

Test panels (24" long×12" wide) were dipped at various viscosities (adjusted by addition of a solvent blend as described above) using various withdrawal rates, as follows:

| Withdrawal Speed | Viscosity | Vapor Blanket | Film Thickness (mils) |
|---|---|---|---|
| 54"/min | 28 poise | 1¾" | Film sags |
| 44"/min | 28 poise | 4¾" | Film sags |
| 44"/min | 28 poise | 8" | Film sags |
| 44"/min | 25 poise | 1½" | Film sags |
| 54"/min | 25 poise | 6½" | Film sags |
| 15"/min | 25 poise | 6" | 8½–8¾ |
| 15"/min | 25 poise | 2" | 8½–9 |
| 18"/min | 26 poise | 7" | 9–9½ |
| 26"/min | 24 poise | 4" | 9–10 |

On an average, the top 2 inches of each panel were about 2 mils less in film thickness than the rest of the panel. Film thickness beyond the initial 2 inches at the top was uniform, within a range of 1 mil.

EXAMPLE 3

To further illustrate various blends of solvents that may be used, the same maskant composition was prepared with various solvent blends, as follows (all numbers being weight percents).

| | A | B | C | D | E | F |
|---|---|---|---|---|---|---|
| Film Forming Matrix | 31.5 | 31.4 | 31.9 | 30.7 | 32.4 | 30.8 |
| Methylene Chloride | 55.3 | 56.0 | 54.4 | 50.4 | 58.0 | 51.5 |
| Methyl Chloroform | 8.2 | 7.6 | 5.1 | 17.8 | — | 12.7 |
| Methyl Ethyl Ketone | 5.0 | — | — | — | — | — |
| Acetone | — | — | — | 1.1 | — | — |
| Butyl Acetate | — | — | — | — | 3.0 | — |
| Cellosolve | — | — | — | — | — | 1.3 |
| Toluene | — | 5.0 | 8.6 | — | — | — |
| Petroleum Naphtha | — | — | — | — | 6.6 | 3.2 |
| Total % by wt. | 100 | 100 | 100 | 100 | 100 | 100 |
| Solubility Parameter | 9.3 | 9.43 | 9.4 | 9.44 | 9.3 | 9.36 |
| Visc. Poise | 25 | 23 | 19 | 21 | 19 | 19 |

It can readily be seen that the viscosity may vary dependent on the blend but it can be adjusted by increasing or reducing the amount of solvent blend and or amount of viscosity modifier. The preferred and practical viscosity falls within a range of 25 to 38 poise at a withdrawal rate of 12" to 26" per minute with a vapor blanket of 2" to 6" over surface of the bath.

It has also been found that for acceptable film quality it is necessary to control the part temperature, the ambient temperature and humidity in addition to the withdrawal rate, viscosity and the height of the vapor blanket.

We claim:

1. A process for applying a volatile liquid maskant to an article to be subjected to chemical milling, the process including the steps:

(a) providing a controlled temperature bath of said volatile maskant characterized as fast drying, providing a vapor blanket overlying the bath, and also maintaining the temperature of the vapor blanket at less than the bath temperature, (b) placing the article into position above the level of the bath and blanket, and adjusting the temperature of the article in relation to the bath temperature, so that the temperature of the article surface is about 70° F. which is about 4° F. less than the bath temperature, prior to lowering of the article through the vapor blanket, and prior to contact of the article with the bath, (c) lowering the article through the blanket into the bath, and withdrawing the article upwardly from the bath and through the blanket at a controlled rate between 12 and 26 inches per minute characterized in that the maskant coats the article to controlled coat thickness, and also in that the bath remains substantially free of return drainage of maskant off the withdrawn article, (d) and, following said upward withdrawal, flowing a gas stream into contact with the maskant coat while the article remains above the level of the bath to assist in rapid drying of the maskant, the maskant coating having a thickness within the range of about 4 to 12 mils, (e) the maskant consisting essentially of a volatile hydrocarbon solvent, and solids including elastomeric material, phenolic resin, and filler dissolved in the solvent, a major volumetric proportion of the solvent consisting of methylene chloride.

2. The process of claim 1 wherein the temperature adjustment is effected by flowing a controlled temperature gas stream into contact with the article while the article remains openly poised above the blanket and bath.

3. The process of claim 2 wherein said controlled temperature gas stream is introduced into an enclosed zone into which the article is displaced to become poised above the blanket and bath, and including removing said gas from said zone during said temperature adjustment.

4. The process of claim 1 wherein said gas stream flowing into contact with the maskant coat is introduced into an enclosed zone into which the coated article is withdrawn upwardly above the level of the bath and blanket, and including the step of withdrawing gas from said zone during drying of the maskant in said zone.

5. The process of claim 4 including the step of removing hydrocarbon from the gas withdrawn from said zone, and recirculating the gas to said zone to flow into contact with the maskant coating.

6. The process of claim 5 including the step of dehumidifying the recirculated gas.

7. The process of claim 5 including the step of controlling the temperature of said recirculating gas.

8. The process of claim 1 including the step of controllably circulating the maskant liquid in the bath.

9. The process of claim 1 including the step of controlling the viscosity of the maskant liquid in the bath so that only a single dip of the article is required to coat the article to required maskant thickness.

10. The process of claim 1 wherein the solvent consists of a mixture having the following composition:

| | % by volume |
|---|---|
| Methylene Chloride | 65–100 |
| 1,1,1-Trichloroethane | 0–26 |
| Perchloroethylene | 0–18 |
| Toluene | 0–20 |
| Ketones | 0–20 |
| Glycol Ethers | 0–5 |
| Petroleum Naphthas | 0–18 |

11. The process of claim 1 wherein the solids dissolved in the solvent have the following composition:

| | weight parts |
|---|---|
| Elastomer | 100 |
| Phenolic Resin (Heat Reactive) | 4–15 |
| Hydrocarbon Resins | 0–15 |
| Extending or Rubber Processing Oil | 0–10 |
| Reinforcing/Extending Fillers | 65–175 |
| Antioxidants | 0–5 |
| Reactive Polyvalent Metal Oxide | 1–10 |
| Viscosity Modifier | 0–15 |
| Liquid Organic Polymer | 2–10 |

12. The process of claim 1 wherein said maskant has a composition comprising a film forming solids matrix and a solvent therefor, the bulk of the solvent consisting of methylene chloride, the liquid composition having a viscosity of between about 25 and 38 poise in a bath from which parts are slowly withdrawn at rates between about 12 and 26 inches per minute.

13. The method of claim 1 wherein said coating constitutes the only maskant coating on the article and is a single coating.

* * * * *